US006578634B2

(12) United States Patent
Newman

(10) Patent No.: US 6,578,634 B2
(45) Date of Patent: Jun. 17, 2003

(54) METHOD OF MONITORING PUMPING OPERATIONS OF A SERVICE VEHICLE AT A WELL SITE

(75) Inventor: Frederic M. Newman, Midland, TX (US)

(73) Assignee: Key Energy Services, Inc., Midland, TX (US)

( * ) Notice: Subject to any disclaimer, the term of this patent is extended or adjusted under 35 U.S.C. 154(b) by 72 days.

(21) Appl. No.: 09/945,924

(22) Filed: Sep. 5, 2001

(65) Prior Publication Data

US 2003/0042020 A1 Mar. 6, 2003

(51) Int. Cl.[7] ..... E21B 47/00
(52) U.S. Cl. ..... 166/250.01; 166/275; 73/152.29
(58) Field of Search ..... 166/250.01, 275, 166/244.1; 364/143; 73/152.29

(56) References Cited

U.S. PATENT DOCUMENTS

| | | | |
|---|---|---|---|
| 3,760,362 A | | 9/1973 | Copland et al. |
| 3,921,152 A | | 11/1975 | Hagar et al. |
| 4,187,546 A | | 2/1980 | Heffernan et al. |
| 4,393,485 A | | 7/1983 | Redden |
| 4,531,204 A | | 7/1985 | Vanderschel |
| 4,545,017 A | | 10/1985 | Richardson |
| 4,604,724 A | | 8/1986 | Shaginian et al. |
| 4,794,534 A | | 12/1988 | Millheim |
| 4,858,130 A | * | 8/1989 | Widrow |
| 4,916,617 A | | 4/1990 | Norwood |
| 5,051,962 A | | 9/1991 | Eaton |
| 5,132,904 A | | 7/1992 | Lamp |
| 5,216,638 A | | 6/1993 | Wright |
| 5,237,539 A | | 8/1993 | Selman |
| 5,278,549 A | | 1/1994 | Crawford |
| 6,079,490 A | | 6/2000 | Newman |

* cited by examiner

*Primary Examiner*—Roger Schoeppel
(74) *Attorney, Agent, or Firm*—Howrey Simon Arnold & White, LLP

(57) ABSTRACT

A method monitors pumping operations of a vehicle that pumps various fluid treatments down into a well being serviced at a well site. The method records the vehicle's engine speed and the values of one or more fluid-related variables, such as pressure, temperature, flow rate, and pump strokes per minute. The values are recorded as a function of the time of day that the variables and engine speed were sensed. In some embodiments, the recorded values are communicated over a wireless communication link from a remote well site to a central office.

32 Claims, 10 Drawing Sheets

METHOD OF MONITORING PUMPING OPERATIONS OF A SERVICE VEHICLE AT A WELL SITE

BACKGROUND OF THE INVENTION

1. Field of the Invention

The invention generally pertains to service vehicles used in performing work at a well site, and more specifically to a method of monitoring the vehicle's pumping operations.

2. Description of Related Art

After a well is set up and operating to draw petroleum, water or other fluid up from within the ground, various services are periodically performed to maintain the well in good operating condition. Such services may involve pumping various fluids down into the well such as pressurized water, hot oil and various chemicals. Since wells are often miles apart from each other, such pumping operations are usually performed using a is service vehicle, such as a chemical tank truck, a high pressure fluid pumping truck, or a hot oil tank truck.

Service vehicles are often owned by independent contractors that well companies (e.g., well owner or operator) pay to service the wells. Well owners typically have some type of contractual agreement or "master service agreement" with their various contractors. The agreement generally specifies what goods and services are to be provided by the contractor, the corresponding fees, and may even specify other related items such as operating procedures, safety issues, quantity, quality, etc.

Service operations are usually performed at well sites that are remote to the well owner's main office. The well may even be hundreds of miles apart. So, it can be difficult for a well owner to confirm whether a contractor is fully complying with his part of the agreement. Without a company representative at the well site to witness the services being performed, the well owner may have to rely on whatever report or invoice the contractor supplies. This can lead to misunderstandings, false billings, payment delays, suspicions, and disagreements between the contractor and the well owner. To further complicate matters, in a single day, service contractors may do work at different wells for different well owners. Thus, a contractor could mistakenly bill one well owner for work done on a well of another owner.

SUMMARY OF THE INVENTION

To provide an improved method of monitoring pumping operations at a well site, it is an object of the invention to collect data at a well site and communicate the collected data to a remote location.

A second object of some embodiments is to monitor the pumping of a fluid down through a string of tubing of the well.

A third object of some embodiments is to monitor the forcing of fluid up through an annulus between a well's casing string and tubing string.

A fourth object of some embodiments is to digitize readings pertaining to the pumping of fluid into a well, so the readings are readily transferable via the Internet and/or through a wireless communication link.

A fifth object of some embodiments is to monitor several variables associated with the pumping of fluid into a well to help identify problems with the well.

A sixth object of some embodiments is to record with reference to time variables associated with pumping fluid into a well.

A seventh object of some embodiments is to record with reference to time and a pumping variable the speed of a vehicle's engine to help determine whether the vehicle is traveling or pumping.

An eighth object of some embodiments is to plot a graph of pump discharge pressure and the fluid pressure of an annulus of a well to help identify problems with the well.

A ninth object of some embodiments is to employ a telephone-related modem, a cellular phone, and/or a satellite in communicating fluid pumping operations to a remote location.

A tenth object of some embodiments is monitor the fuel consumption with reference to time of a vehicle used for servicing a well.

An eleventh object of some embodiments is to monitor the pumping of various fluids into a well, wherein the fluids may include a scale inhibitor, an emulsion breaker, a bactericide, a paraffin dispersant, or an antifoaming agent.

A twelfth object of some embodiments is to provide a data record that allows one to distinguish between whether a fluid is being pumped into a well or into a tank battery.

A thirteenth object of some embodiments is to determine the volume of a fluid being pumped down into a well by counting the cycles of a reciprocating pump.

One or more of these objects are provided by a method of monitoring pumping operations of a vehicle at a well site. The method records the values of one or more fluid-related variables and vehicle engine speed. The values are recorded as a function of the time of day that the variables were sensed.

DESCRIPTION OF THE PREFERRED EMBODIMENT

Figure 1:
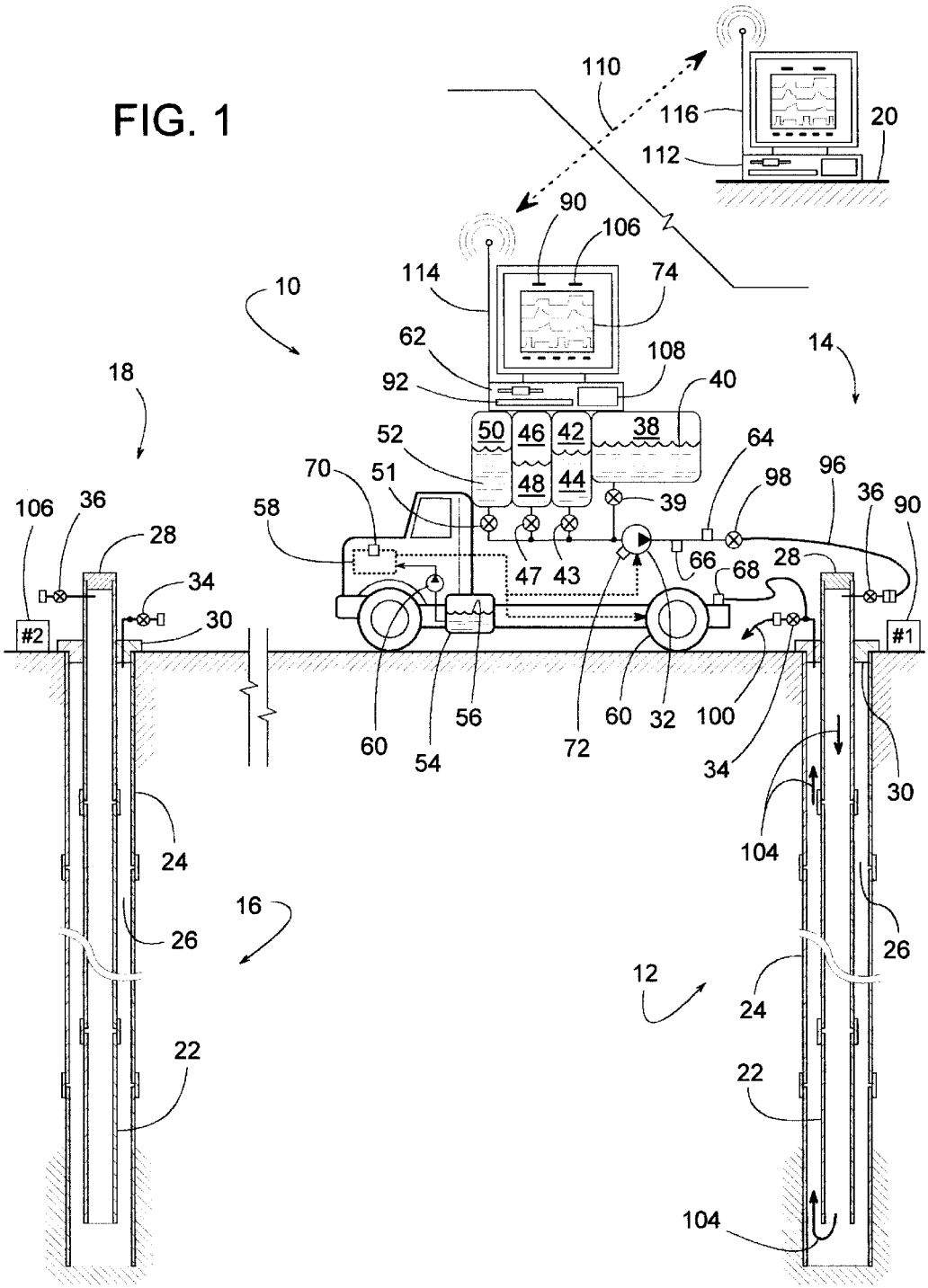
FIG. 1 is a schematic diagram illustrating a method of monitoring a service vehicle's pumping operations at a first well site according to some embodiments of the invention.
Figure 2:
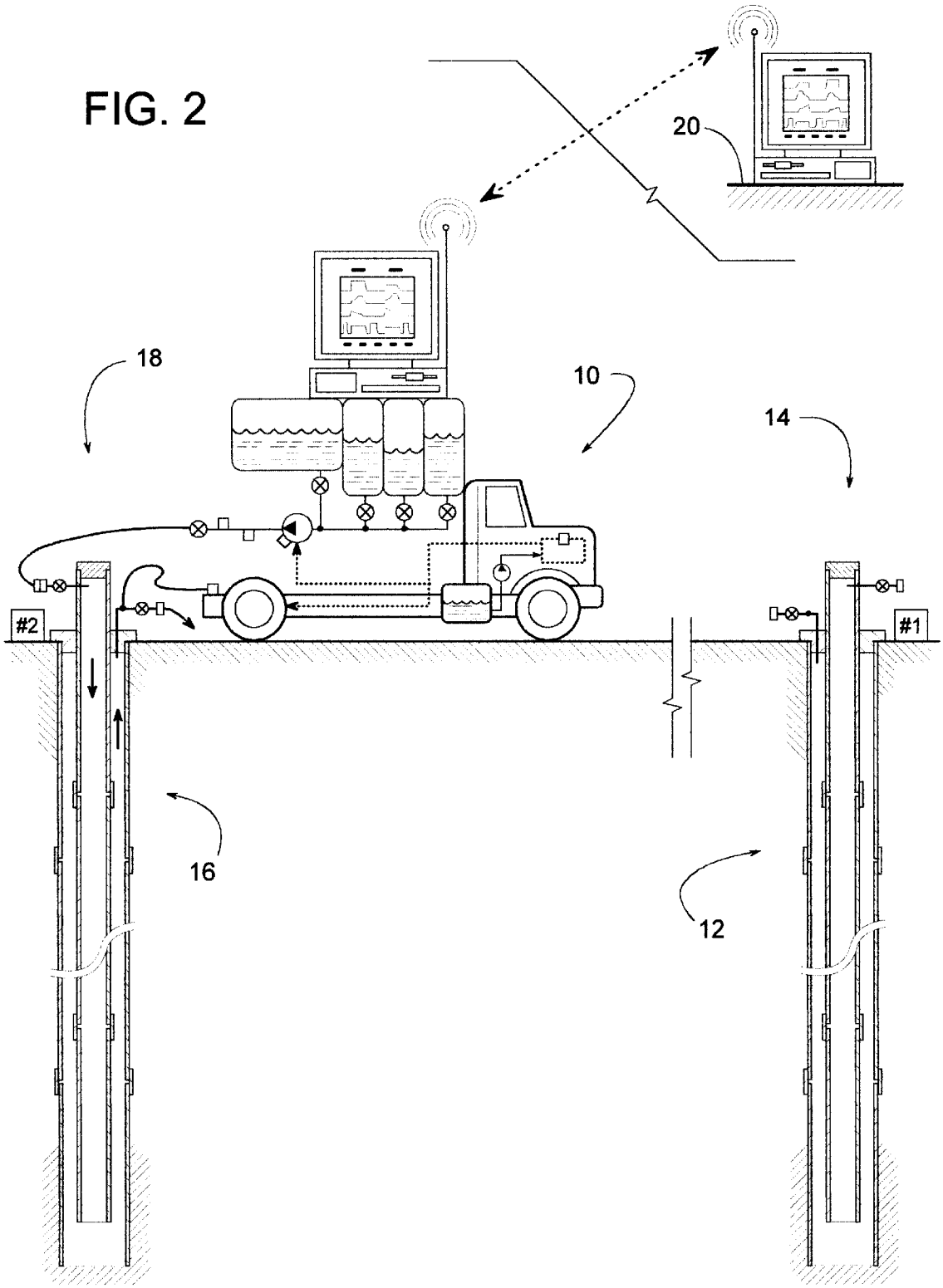
FIG. 2 is similar to FIG. 1, but showing the vehicle pumping fluid at a second well site.

FIGS. 1 and 2 illustrate a vehicle 10 for servicing a first well 12 at a first well site 14 and a second well 16 at a second well site 18. The two well sites 14 and 18 are remote in that they are miles apart from each other and miles apart from a main office 20. Wells 14 and 18 each include a string of tubing 22 disposed within a string of casing 24. Under normal operation, petroleum, water, gas or other ground-source fluid passes through openings in casing 24 to enter an annulus 26 between the inner wall of casing 24 and the outer wall of tubing 22. From annulus 26, the fluid is then pumped or otherwise forced upward through the interior of tubing 22, so the fluid can be extracted at ground level for later use or processing.

To facilitate certain operations of servicing a well, an end cap 28 may be temporarily installed at the upper end of tubing 22. With tubing 22 capped and an annular seal 30 installed between tubing 22 and casing 24, a servicing fluid can be forced through annulus 26 and/or tubing 22. A pump 32 on vehicle 10 can force the servicing fluid into the well via an annulus valve 34 open to annulus 26 or a tubing valve 36 open to tubing 22.

Vehicle 10 is schematically illustrated to represent any fluid-pumping vehicle, examples of which include, but are not limited to, a tanker truck, fluid pumping truck, kill truck, chemical truck, treating truck, and hot oil truck. Vehicle 10 includes at least one tank for holding a fluid and at least one pump for pumping the fluid. Examples of the fluid being pumped include, but are not limited to, water (pure or with some additives), hot oil, fuel to power vehicle 10 (e.g., gasoline or diesel fuel), a scale inhibitor (e.g., DynoChem 1100 by DynoChem of Midland, Tex.), an emulsion breaker (e.g., DynoChem 5400 by DynoChem), a bactericide (e.g., DynoCide #4 by DynoChem), paraffin dispersant (e.g., CynoChem 7498 by DynoChem), and an antifoaming agent (e.g., DynoChem 4690 by DynoChem). In some embodiments, vehicle 10 includes a first tank 38 for water 40, a second tank 42 for a paraffin dispersant 44, a third tank 46 for a scale inhibitor 48, a fourth tank 50 for a bactericide 52, and a fuel tank 54 for fuel 56 to power an engine 58 of vehicle 10. Engine 58 is coupled to power drive wheels 60 of vehicle 10 and is further coupled to drive pump 32, which is adapted to selectively pump fluids 40, 44, 48 and 52 into a well. Valves 39, 43, 47 and 51 allow pump 32 to selectively draw fluid from tanks 38, 42, 46 and 50 respectively. A fuel pump 60 pumps fuel 56 from tank 54 to engine 58, which allows vehicle 10 to drive between well sites and power pump 32.

Vehicle 10 carries an electrical data storage device, such as a data collector 62 that receives input signals from various feedback devices for monitoring the operations of vehicle 10. Data collector 62 is schematically illustrated to include any device for collecting, manipulating, converting, transferring and/or storing digital data. Examples of data collector 62 include, but are not limited to, a personal computer, PC, desktop computer, laptop, notebook, PLC (programmable logic controller), data logger, etc. Examples of the various feedback devices include, but are not limited to, a pump discharge pressure sensor 64; a pump discharge flow meter 66; an annulus pressure sensor 68, a tachometer 70 (i.e., any device that provides a signal useful in determining a relative speed of engine 58); and a counter 72 that indicates the strokes per minute of a reciprocating pump, such as pump 32. Feedback devices 64, 66, 68 and 72 are examples of devices that sense a variable associated with the fluid being pumped, wherein examples of the variable include, but are not limited to pressure, temperature and flow rate. It should be noted that vehicle 10 could have more or less than the feedback devices just mentioned and still remain well within the scope of the invention. For example, counter 72 and flow meter 66 both can provide data collector 62 with an indication of the flow rate of pump 32, so if sensing the flow rate is desired, really only one of counter 72 and flow meter 66 would be needed. Also, additional feedback devices, such as limit switches, could sense the open/closed position of valves 39, 43, 47 and 51 and provide data collector 62 with an indication of which fluid pump 32 is pumping.

In operation, vehicle 10 may travel from a contractor's home base to well 12 to pump water 40 from tank 38 down into tubing 22 and back up through annulus 26. Such an operation is often referred to as, "killing the well" and is used for preparing the well for further maintenance work and/or for checking the well for leaks or flow blockages. Later in the day, vehicle 10 may travel to well 16 for a similar killing operation. At the end of the day, vehicle 10 returns to the contractor's home base. With data collector 62 and feedback devices 64, 66, 68, 70 and 72, the vehicle's sequence of operations for the day is recorded as a stored data record 74. The stored data record 74 comprises various digital values representative of the variable associated with the fluid being pumped, the time of day that the fluid is being pumped, the speed of engine 58, and a well site identifier that indicates at which well vehicle 10 was operating. The stored data record 74 can be displayed in various formats such as a tabulation of digital values and/or corresponding graphical format, as shown in FIG. 3.

The graphical format of data record 74 provides plots of certain key variables as a function of the time of day that the variables were sampled. In FIG. 3, for example, the plotted variables are pump strokes per minutes 76, as sensed by counter 72; tubing pressure 78, as sensed by pressure sensor 64; annulus pressure 80, as sensed by pressure sensor 68; and RPM 82 (revolutions per minute) of engine 58, as measured by tachometer 70. Variables 76, 78, 80 and 82 are plotted with reference to a common X-axis 84 representing the time of day. The displayed plots and values of FIG. 3 comprise one example of a stored data record 74, which is stored by data collector 62. All the values of stored data record 74 are preferably digital for ease of manipulation and storage by data collector 62. Although input from feedback devices 64, 66, 68, 70 and 72 may originate as analog signals, a conventional A/D converter (in the form of a separate circuit or incorporated into data collector 62) converts the signals to digital ones, so the digital values can be readily handled and stored by data collector 62.

Figure 3:
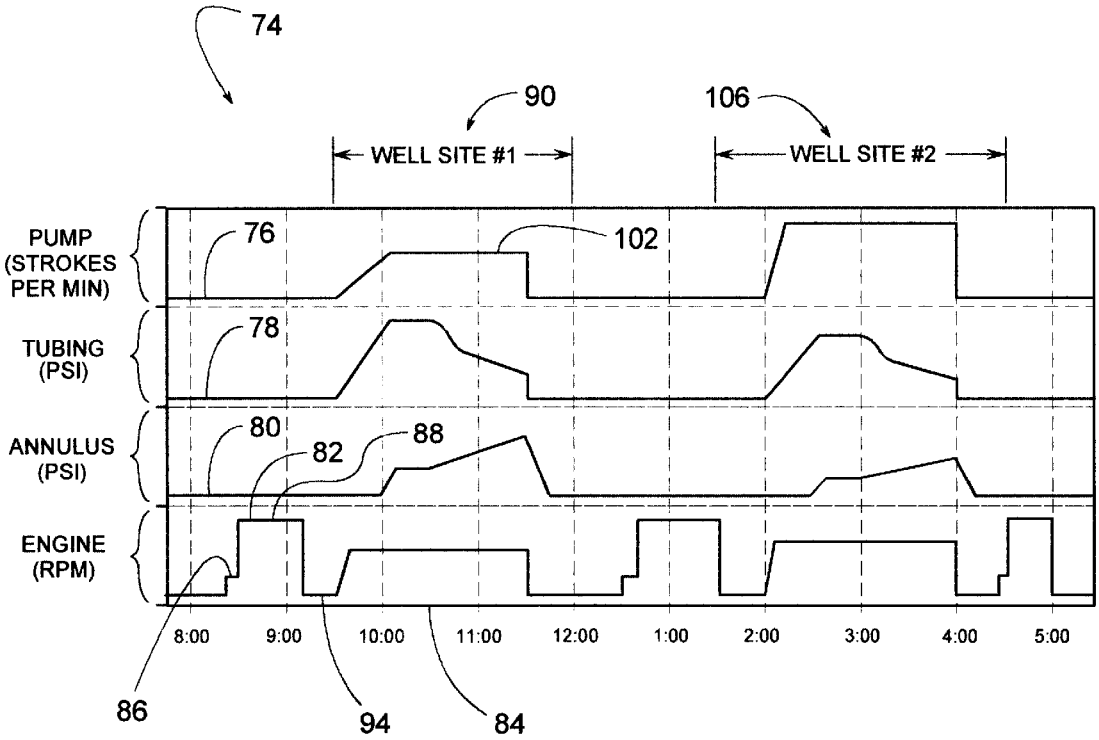
FIG. 3 is a stored data record of digital values that reflect the pumping operations of a vehicle at multiple well sites.

For the example shown in FIG. 3, the vehicle's engine was started just before 8:30am and left idling briefly, as indicated by numeral 86. An elevated RPM reading 88 represents vehicle 10 traveling from the contractor's home base and arriving at first well 12 at about 9:10am. Once at well 12, a first well site identifier 90 that identifies the well by name, description, or location is entered into data collector 62 by way of a key board 92 or by some other data input method. The well site identifier may be the well's APIN (American Petroleum Institute Number), or some other identifier, such as, for example, "WELL SITE #1," as shown in FIG. 3. Numeral 94 indicates engine 58 is idle between 9:10–9:30am, during which time workers are apparently setting up to kill well 12. Setup may involve connecting a hose 96 from a pump discharge valve 98 on vehicle 10 to tubing valve 36 on well 12. Annulus valve 34 may be partially opened to relieve fluid pressure building up due to pump 32 forcing water 40 into tubing 22, which forces fluid upward through annulus 26. Discharge 100 through valve 34 is preferable directed to a holding tank (not shown).

At 9:30 engine 58 begins driving pump 32, as indicated by the engine RPM 82, pump strokes/min 76, and tubing pressure 78 all increasing. Numeral 102 indicates a generally constant flow rate between 10:00 and 11:30. Arrows 104 of FIG. 1 indicate the general direction of fluid flow through tubing 22 and annulus 26. The pressure in tubing 22 peaks shortly after 10:00, and the pressure in annulus 26 peaks just before pump 32 is turned off at 11:30. The pressure of annulus 26 increasing while the pressure in tubing 22 decreases is due to oil originally in tubing 22 being displaced by the heavier water 40 from tank 38. When the pumping ceases at 11:30, tubing pressure 78 drops off almost immediately; however, annulus pressure 80 decreases more slowly, because the standing head of water in tubing 22 continues to apply pressure to fluid in annulus 26 which now contains a higher percentage of relatively light oil. From 11:30 to 12:30, vehicle 10 is inactive, which can mean the crew working on well 12 is taking a lunch break or preparing to leave well site 14.

At 12:30, the RPM of engine 58 increases with no sign of any pumping, which indicates that vehicle 10 is traveling to another well site. At 1:30, the crew of vehicle 10 enters into data collector 62 a second well site identifier 106 to indicate they have arrived at well site 18. Equipment setup occurs between 1:30 and 2:00, and pumping runs from 2:00 to 4:00. Plots 76, 78, 80 and 82 show that the pumping process at well site 18 is similar to that at well site 14. At well site 18, however, the pump strokes/min 76 is higher, while the tubing pressure 78 and the annulus pressure 80 is lower than what was experienced at well site 14. This could indicate that well 12 is deeper and/or provides more flow resistance than well 16. As the service crew prepares to leave well site 18, the plots indicate a period of equipment inactivity between 4:00 and 4:30. At 4:30, the engine RPM curve 82 indicates a short period of engine idling before vehicle 10 travels about 30 minutes back to the contractor's home base for an arrival time of about 5:00.

By knowing the displacement of pump 32, its strokes/min, and how long pump 32 was running at each well, the contractor can now determine the quantity of water that was pumped into wells 12 and 16 and charge the appropriate well owners accordingly.

In some embodiments of the invention, data collector 62 includes communication equipment 108 (e.g., a modem, cell phone, etc.—all of which are schematically depicted as communication equipment 108). Communication equipment 108 enables stored data record 74 to be transmitted via the Internet (or other communication system) over a wireless communication link 110 (e.g., airwaves, satellite, etc.) to a computer 112 at a location remote relative to well sites 14 and 18. Computer 112 may be at the main office of the well owner or at the contractor's home base, so the owner or the contractor can monitor operations at the well site even though they may be miles from the site. The term "wireless communication link" refers to data being transmitted over a certain distance, wherein over that certain distance the data is transmitted through a medium of air and/or space rather than wires. Wireless communication link 110 is schematically illustrated to represent a wide variety of systems that are well known to those skilled in the art of wireless communication. For example, with a modem and an antenna 114 associated with data collector 62 (particularly in the case where data collector 62 is a computer), and another modem and an antenna 116 for computer 112, data record 74 can be transferred over the Internet between data collector 62 and computer 112. Data record 74 can assume any of a variety of common formats including, but not limited to HTML, e-mail, and various other file formats that may depend on the particular software being used.

Figure 4:
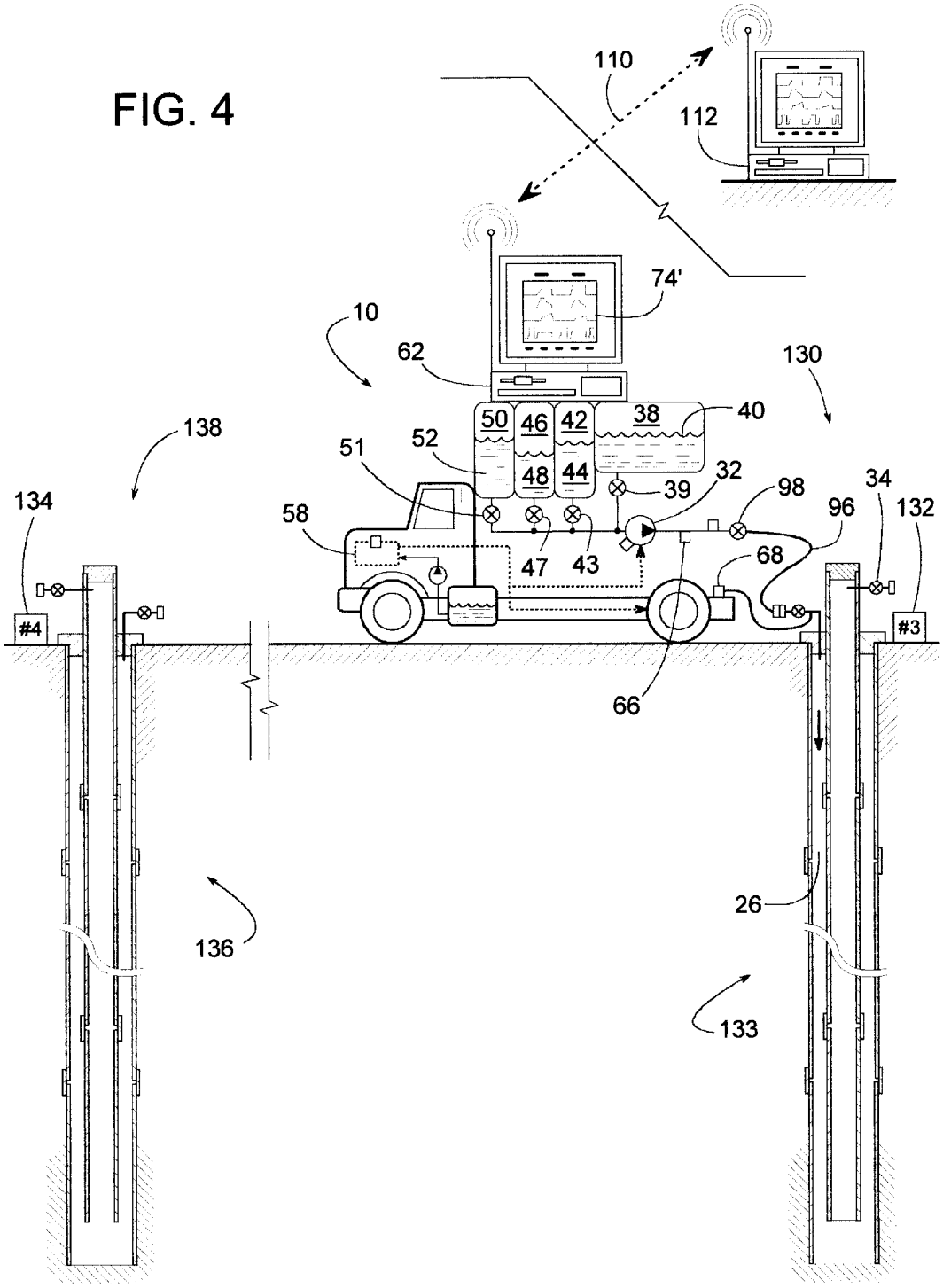
FIG. 4 is similar to FIG. 1, but showing another embodiment of a vehicle's pumping operations at a third well site.
Figure 5:
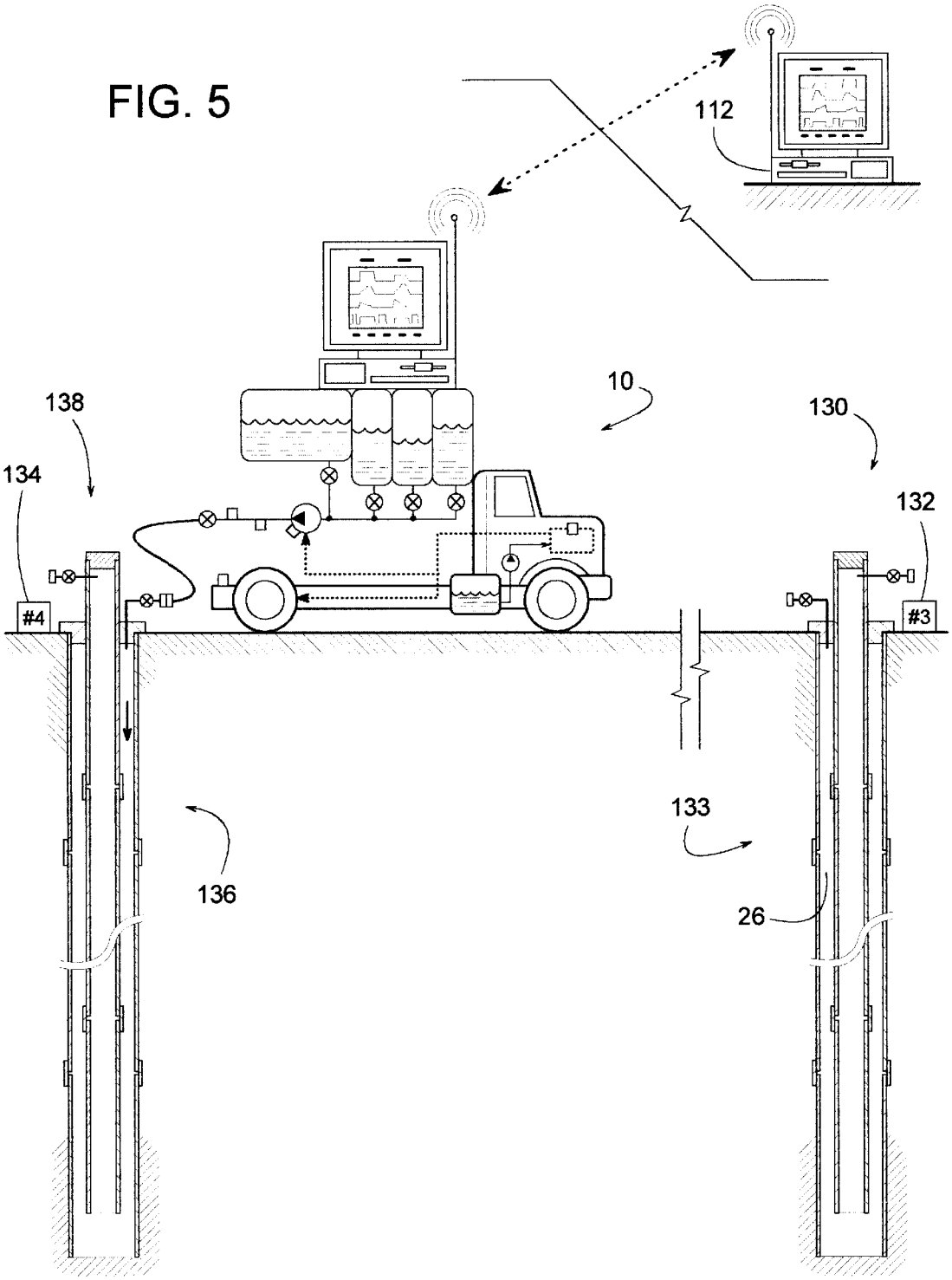
FIG. 5 is similar to FIG. 4, but showing the vehicle pumping fluid at a fourth well site.
Figure 6:
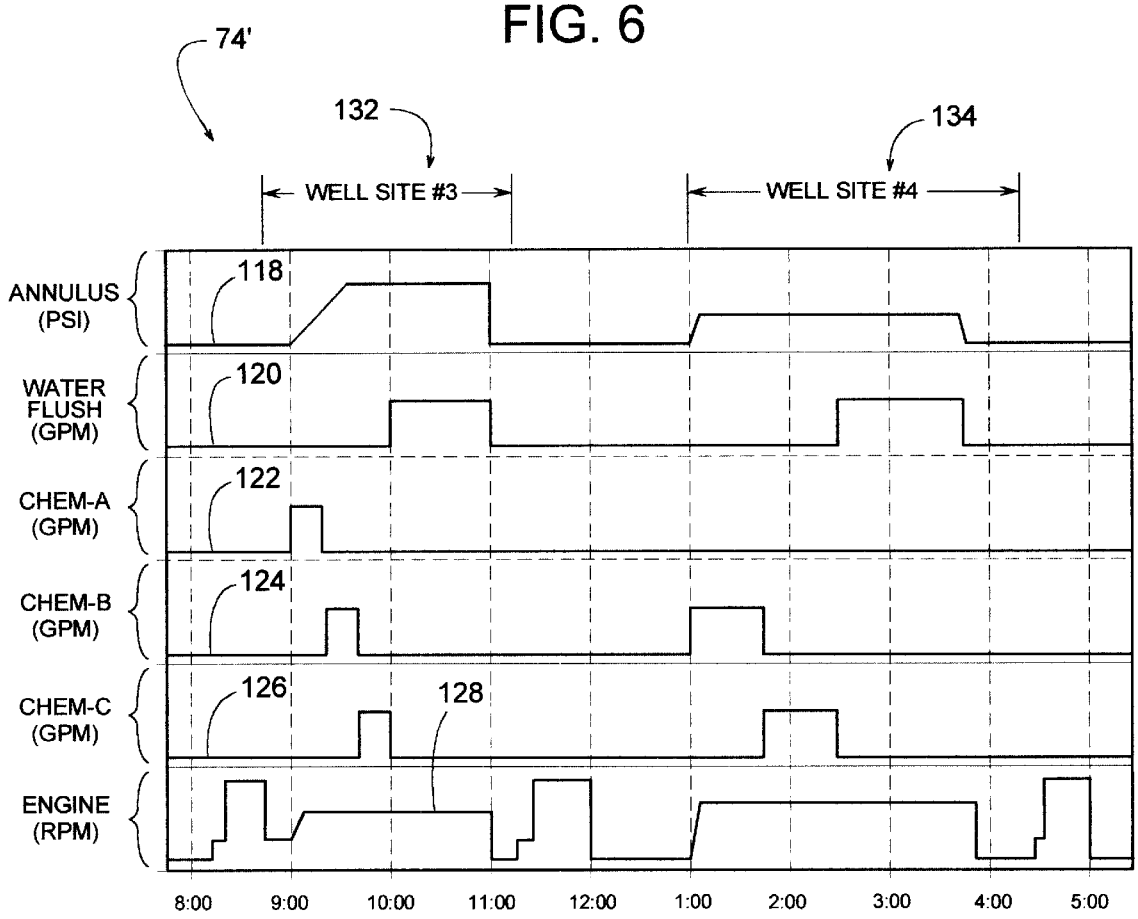
FIG. 6 is a stored data record of digital values that reflect the pumping operations of a vehicle at the well sites of FIGS. 4 and 5.

In another embodiment, illustrated in FIGS. 4, 5 and 6, a stored data record 74' comprises a first plot 118 of annulus pressure, as sensed by pressure sensor 68, a second plot 120 of water flush, as measured in GPM by flow meter 66 when valve 39 is open, a third plot 122 (CHEM-A) of a first chemical of paraffin dispersant 44, as measured in GPM by flow meter 66 when valve 43 is open; a fourth plot 124 (CHEM-B) of a second chemical of scale inhibitor 48, as measured in GPM by flow meter 66 when valve 47 is open; a fifth plot 126 (CHEM-C) of a third chemical of bactericide 52, as measured in GPM by flow meter 66 when valve 51 is open; and a sixth plot 128 of engine RPM. Stored data record ooo indicates that vehicle 10 departs the contractor's home base at about 8:30 and arrives at a well site 130 at about 8:45. Upon arrival, a well site identifier 132 identifying a well 133 at a well site 130 is entered into data collector 62. Equipment setup, which occurs just before 9:00, involves connecting hose 96 from discharge valve 98 to annulus valve 34, as shown in FIG. 4. This allows water and the various chemicals to be selectively and sequentially pumped down into annulus 26.

At 9:00, valves 43, 98 and 34 are opened, valves 39, 47 and 51 are closed, and the speed of engine 58 increases to drive pump 32 to pump CHEM-A from tank 42 down through annulus 26. The pumping continues for about twenty minutes, so the total amount of CHEM-A is determined by multiplying twenty minutes times the GPM reading of flow meter 66.

At 9:20, valve 43 closes and valve 47 opens to pump CHEM-B from tank 46 down through annulus 26; again, for about twenty minutes. At 9:40 valve 47 closes and valve 51 opens to pump CHEM-C from tank 50 down through annulus 26. A water flushing process is performed from 10:00 to 11:00, wherein valve 39 is open and valves 43, 47 and 51 are closed to pump water 40 from tank 38 into annulus 26. The total amounts of water, CHEM-B, and CHEM-C can be determined in the same way as with CHEM-A. In an alternate embodiment, the total volume of water and chemical being pumped is measured directly, and the results are stored and displayed in gallons rather than gallons/minute.

At 11:00, the pumping stops and hose 96 is decoupled from annulus valve 34. Stored data record 74' indicates that vehicle 10 is traveling from about 11:30 to 12:00, and equipment inactivity from 12:00 to 1:00 indicates a lunch break and/or equipment is being setup. A well site identifier 134 identifying another well 136 at another well site 138 is entered into data collector 62.

At 1:00, CHEM-B is pumped into well 136, and at 1:40, CHEM-C is pumped into well 136, as shown in FIG. 5. The two chemicals were each pumped into well 136 for twice as long as when pumped into well 133, so well 136 received twice as much of the two chemicals. However, plot 122 indicates that well 136 did not receive any of CHEM-A. Well 136 received a water flush from 2:30 till about 3:45. It should be noted that the annulus pressure of well 136 is greater than that of well 133, which may indicate that annulus 26 of well 133 is partially obstructed.

Stored data record 74' indicates that vehicle 10 departs well site 138 at about 4:30 and arrives back at the contractor's home base at 5:00. As with the embodiment of FIGS. 1–3, stored data record 74' can be transmitted via wireless communication link 110 from data collector 62 to remote computer 112.

Figure 7:
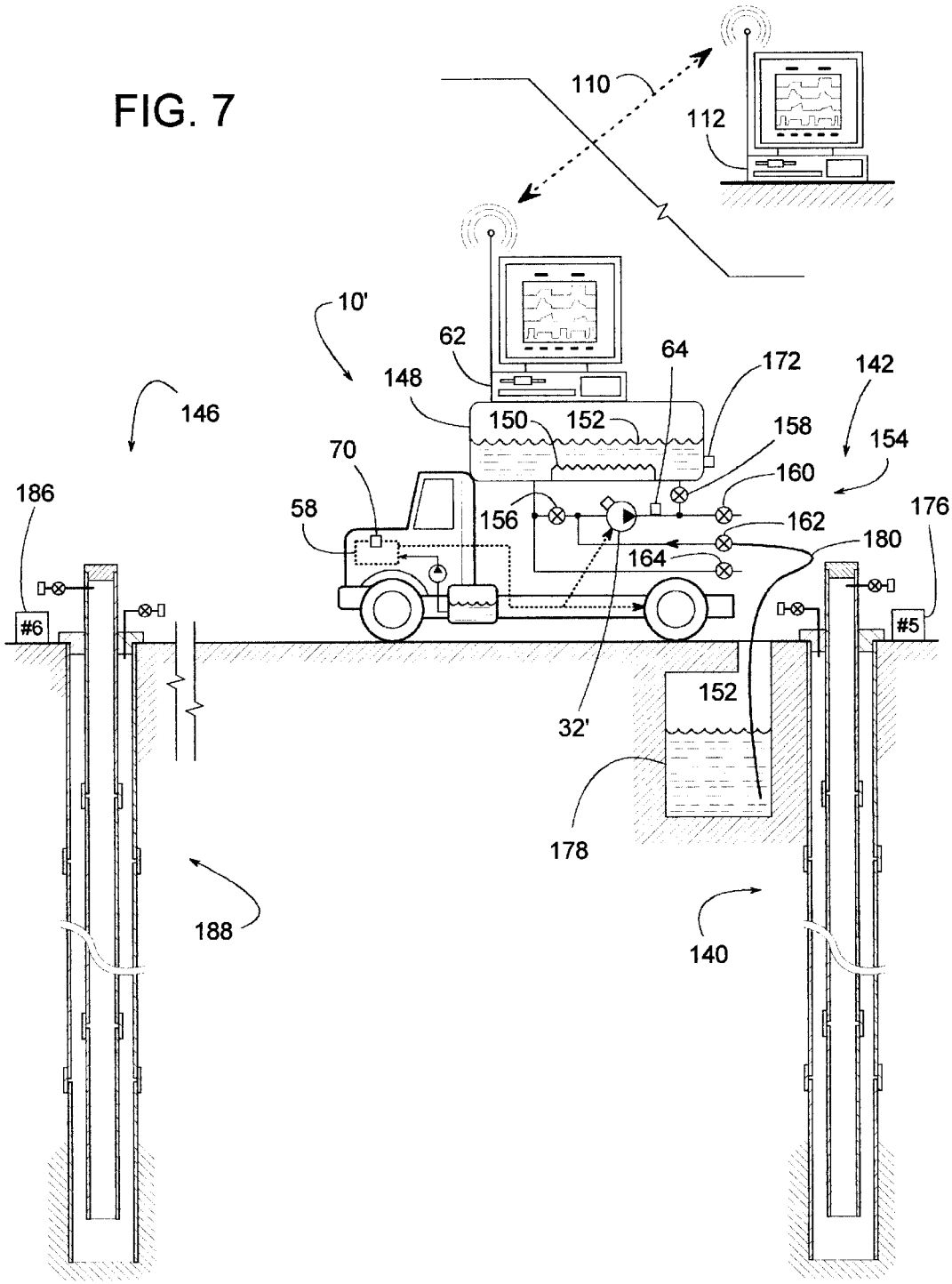
FIG. 7 is a schematic diagram showing a vehicle pumping oil from a tank battery.
Figure 8:
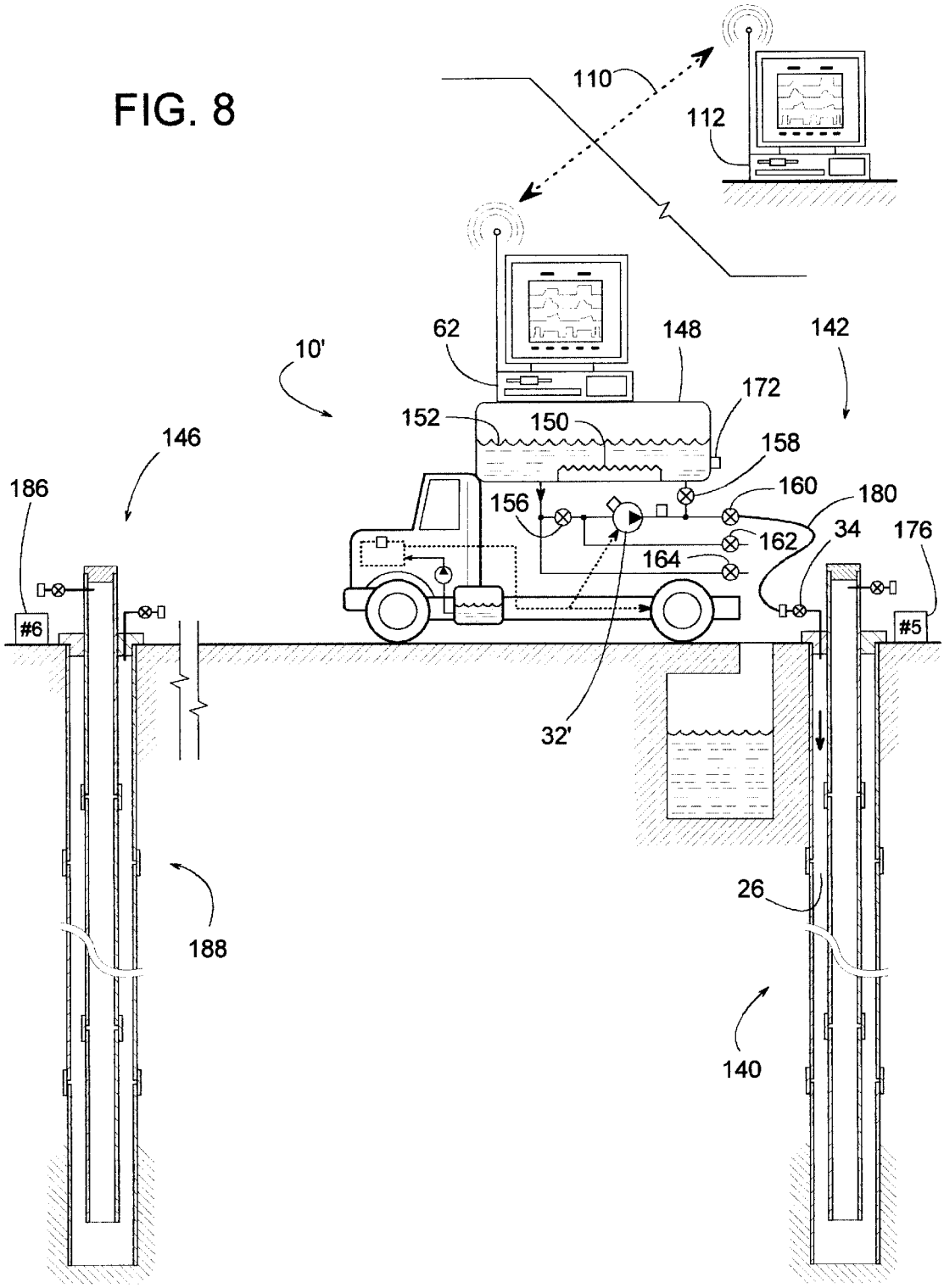
FIG. 8 is a schematic diagram showing the vehicle of FIG. 7 pumping hot oil down into a well at a well site.
Figure 9:
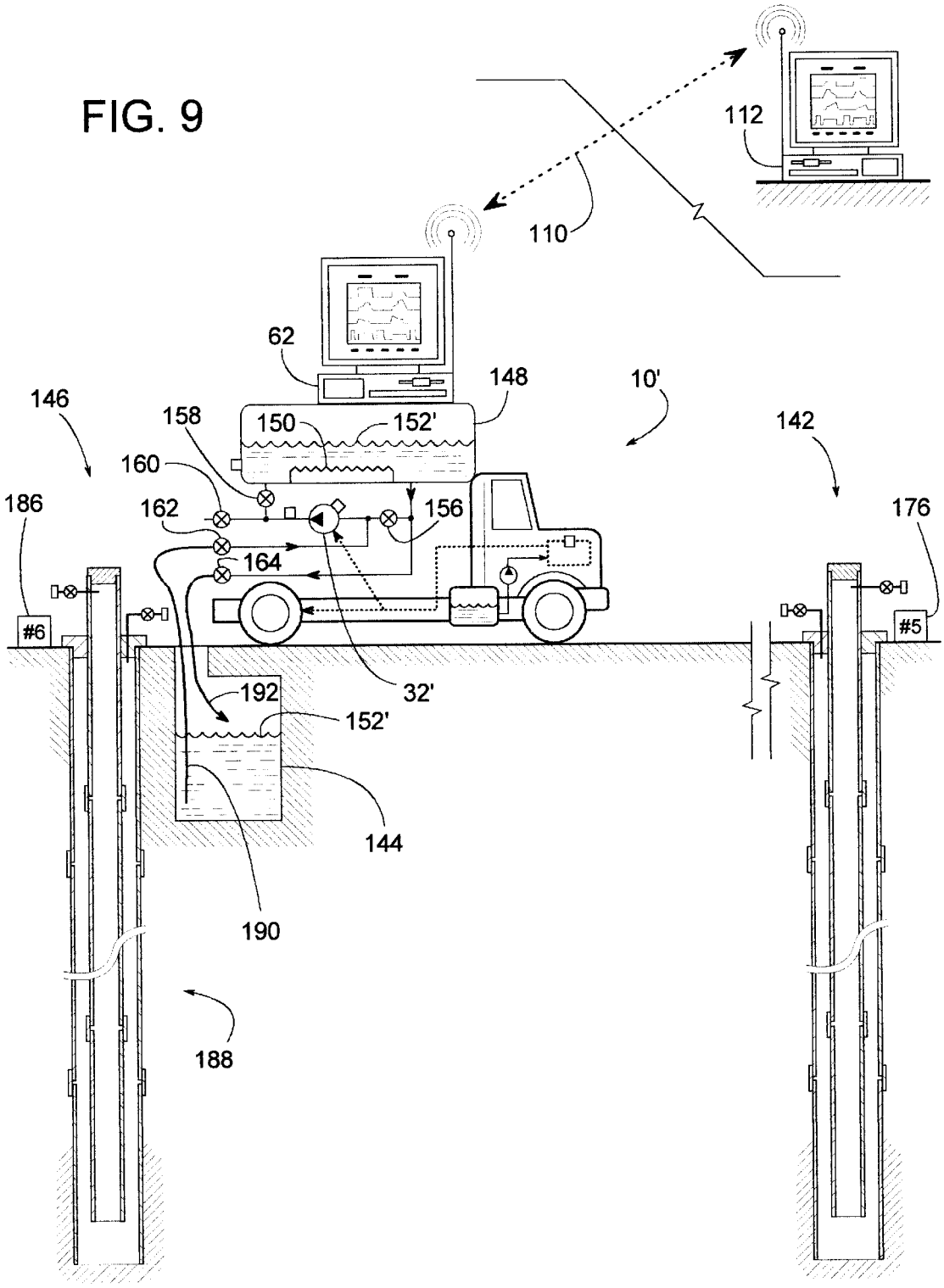
FIG. 9 is a schematic diagram showing the vehicle of FIG. 7 circulating hot oil through a tank battery at another well site.
Figure 10:
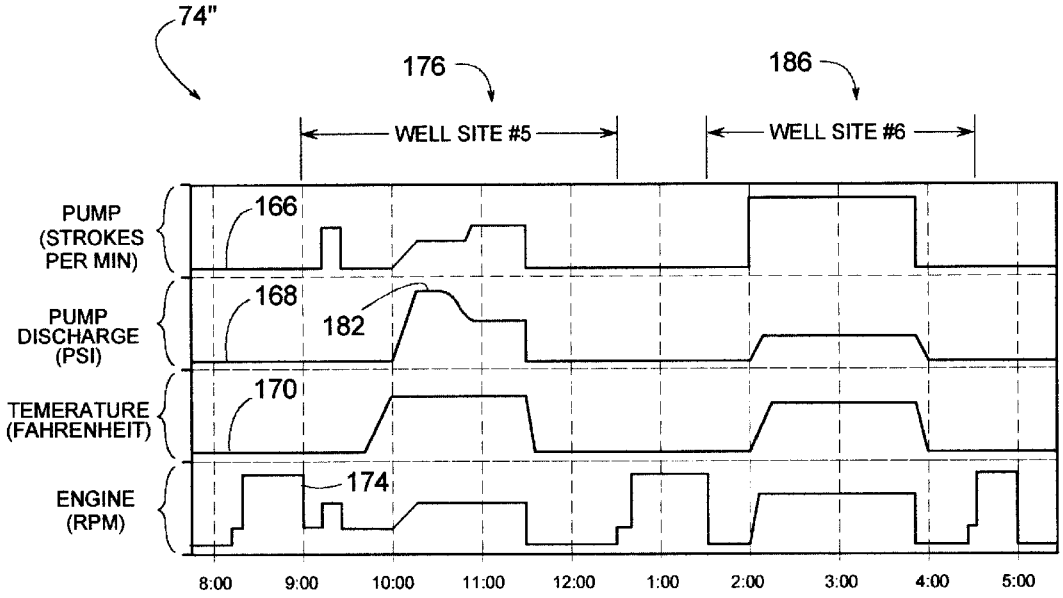
FIG. 10 is a stored data record of digital values that reflect the pumping operations illustrated in FIGS. 7, 8 and 9.

In another embodiment of the invention, shown in FIGS. 7–10, a vehicle 10' provides a hot oil treatment for a well 140 at one well site 142 (FIGS. 7 and 8) and treats a tank battery 144 at another well site 146 (FIG. 9). Vehicle 10' comprises a tank 148 with a heater 150 for storing and heating oil 152. Vehicle 10' also includes a piping system 154 through which oil is directed by valves 156, 158, 160, 162 and 164. FIG. 10 illustrates a stored data record 74" that captures the activities of vehicle 10' throughout a day. Data record 74" includes a first plot 166 of pump strokes/min of a pump 32'; a second plot 168 of pump discharge pressure as sensed by pressure sensor 64; a third plot 170 of oil temperature, as sensed by a temperature sensor 172, and a fifth plot 174 of the speed of engine 58, as sensed by tachometer 70.

Referring to FIG. 10, vehicle 10' drives to well site 142 from 8:15 to 9:00, and a well site identifier 176 is entered into data collector 62.

Referring further to FIG. 7, pump 32' draws oil 152 from a tank battery 178 (i.e., any vessel above or below ground for holding oil) through a hose connected to valve 162. This begins at about 9:15. Valves 164, 160 and 156 are closed, and valves 162 and 158 are open to direct oil in series through hose 80, valve 162, pump 32', valve 158 and into tank 148.

From about 9:30 to 10:00, heater 150 heats oil 152 to a certain temperature, as sensed by temperature sensor 172. In addition, the setup of vehicle 10' is switched over, so hose 180 connects valve 160 to annulus valve 34, as shown in FIG. 8. By 10:00, oil 152 reaches the proper temperature, and valves 156, 160 and 34 are opened (valves 162, 164 and 158 are closed) to allow pump 32' to force the heated oil 152 down through annulus 26. This pumping process runs till 11:30. A blockage in annulus 26 caused the pump discharge pressure to be relatively high at first, as indicated by an initial hump 182 in plot 168, but the pressure fell after the hot oil dissolved the obstruction.

From 11:30 to 12:30, vehicle 10' is disconnected from well 140, and the service crew breaks for lunch. At 12:30, vehicle 10' departs well site 142, arrives at a well 188 at well site 146 at 1:30, and an appropriate well site identifier 186 is entered into data collector 62.

To provide tank battery 144 with a hot oil treatment, vehicle 10' is setup at well site 146, as shown in FIG. 9. Here, a suction hose 190 runs between valve 162 and oil 152' in tank battery 144, and a return hose 192 extends between valve 164 and tank battery 144. Valves 160 and 56 are closed, and valves 162, 164 and 158 are opened to circulate oil in series through suction hose 190, valve 162, pump 32', valve 158, tank 148, valve 164, and return hose 192. As oil 152' passes through tank 148, heater 150 heats oil 152' to a predetermined temperature. This hot oil circulation process runs from 2:00 to about 3:50. It should be noted that plot 168 shows that the pump discharge pressure is significantly lower at 3:00 than at 10:30, which allows one to conclude that a well was being treated at well site 142 and that a tank battery was being treated at well site 146.

Stored data record 74" indicates that vehicle 10' departs well site 146 at about 4:30 and arrives back at the contractor's home base at 5:00. Similar to certain other embodiments of the invention, stored data record 74" can be transmitted via wireless communication link 110 from data collector 62 to remote computer 112.

Although the invention is described with reference to a preferred embodiment, it should be appreciated by those skilled in the art that various modifications are well within the scope of the invention. For example, the stored data record for pumping fluid into a well or a tank battery could also apply to pump 60 pumping fuel 56 from tank 54 to engine 58, whereby fuel consumption of a vehicle can be monitored. Also, since the vehicles are schematically illustrated, the actual configuration of the vehicles' pumps, tanks, valves, piping, etc. can vary widely and still remain well within the scope of the invention. Therefore, the scope of the invention is to be determined by reference to the claims that follow.

I claim:

1. A method of monitoring pumping operations at a well site, wherein the well site includes a well with a string of tubing within a string of casing to define an annulus therebetween, the method comprising:

driving a vehicle to the well site, wherein the vehicle includes a tank, a pump, and an engine adapted to propel the vehicle;

determining a well site identifier of the well site;

pumping a fluid from the tank;

sensing a variable associated with the fluid;

determining a time of day that the fluid is being pumped;

storing on an electrical data storage device a first digital value representative of the well site identifier, a second digital value representative of the variable associated with the fluid, and a third digital value representative of the time of day that the fluid was being pumped, thereby creating a stored data record; and communicating the stored data record to a remote location relative to the well site.

2. The method of claim 1, further comprising pumping the fluid down into the string of tubing.

3. The method of claim 1, further comprising forcing the fluid upward through the annulus.

4. The method of claim 1, wherein the fluid is mostly water.

5. The method of claim 1, wherein the variable is pump discharge pressure.

6. The method of claim 1, wherein the variable is a fluid return pressure of the annulus.

7. The method of claim 1, wherein the variable represents a flow rate of the fluid.

8. The method of claim 7, further comprising determining the flow rate of the fluid as a function of an operating speed of the pump.

9. The method of claim 1, further comprising: sensing an engine speed of the vehicle; determining a second time of day that the engine speed of the vehicle was sensed, storing on the electrical data storage device a fourth digital value representative of the engine speed; storing on the electrical data storage device a fifth digital value representative of the second time of day; and communicating the fourth digital value and the fifth digital value to the remote location.

10. The method of claim 1, wherein sensing the variable associated with the fluid further comprises sensing a discharge pressure of the pump and sensing a fluid return pressure of the annulus.

11. The method of claim 10, further comprising creating a chart that compares the discharge pressure of the pump, the fluid return pressure of the annulus.

12. The method of claim 1, further comprising driving the pump via the engine.

13. The method of claim 1, wherein communicating the stored data to the remote location is carried out through a wireless communication link.

14. The method of claim 13, wherein communicating the stored data to the remote location is carried out through a modem.

15. The method of claim 13, wherein communicating the stored data to the remote location is carried out through a cellular phone.

16. The method of claim 1, wherein the fluid is a fuel for the engine.

17. The method of claim 1, further comprising determining the engine's speed and storing on the electrical data storage device a fourth digital value representative of the engine's speed.

18. The method of claim 17, further comprising plotting the fourth digital value as a function of time.

19. The method of claim 1, further comprising plotting the second digital value as a function of time.

20. The method of claim 1, wherein the vehicle includes a second tank and further comprising:

pumping a second fluid from the second tank into the annulus;

sensing a second variable associated with the second fluid;

determining a second time of day that the second fluid was being pumped;

storing on the electrical data storage device a fourth digital value representative of the second variable associated with the second fluid; and storing on the electrical data storage device a fifth digital value representative of the second time of day that the second fluid was being pumped.

21. The method of claim 1, wherein the fluid is a scale inhibitor.

22. The method of claim 1, wherein the fluid is an emulsion breaker.

23. The method of claim 1, wherein the fluid is a bactericide.

24. The method of claim 1, wherein the fluid is a paraffin dispersant.

25. The method of claim 1, wherein the fluid is an antifoaming agent.

26. The method of claim 1, further comprising:

pumping the fluid into the tank at the well site; and heating the fluid before pumping the fluid from the tank.

27. The method of claim 1, wherein the variable associated with the fluid is temperature.

28. The method of claim 1, wherein the variable associated with the fluid is a rate of pump strokes of the pump.

29. A method of monitoring pumping operations at a well site, wherein the well site includes a well with a string of tubing within a string of casing to define an annulus therebetween, the method comprising:

driving a vehicle to the well site, wherein the vehicle includes a tank, a pump, and an engine adapted to propel the vehicle;

pumping a fluid from the tank into the well;

forcing the fluid through the annulus;

sensing a variable associated with the fluid;

monitoring a speed of the engine; and plotting as a function time a first value representative of the variable associated with the fluid and a second value representative of the speed of the engine.

30. The method of claim 29, wherein the fluid is forced upward through the annulus.

31. The method of claim 29, wherein the fluid is forced downward through the annulus.

32. A method of monitoring pumping operations at a first well site and at a second well site, wherein the first well site includes a first well with a first string of tubing within a first string of casing to define a first annulus therebetween and the second well site includes a second well with a second string of tubing within a second string of casing to define a second annulus therebetween, the method comprising:

driving a vehicle to the first well site, wherein the vehicle includes a tank, a pump, and an engine adapted to propel the vehicle;

determining a first well site identifier of the first well site;

pumping a fluid from the tank and into the first well;

sensing a variable associated with the fluid;

determining a first time of day that the fluid is being pumped into the first well;

storing on an electrical data storage device a first digital value representative of the first well site identifier, a second digital value representative of the variable associated with the fluid, and a third digital value representative of the first time of day that the fluid was being pumped into the first well, thereby creating a first stored data record;

driving the vehicle from the first well site to the second well site;

determining a second well site identifier of the second well site;

pumping the fluid from the tank and into the second well;

sensing a variable associated with the fluid;

determining a second time of day that the fluid is being pumped into the second well;

storing on the electrical data storage device a fourth digital value representative of the second well site identifier, a fifth digital value representative of the variable associated with the fluid, and a sixth digital value representative of the second time of day that the fluid was being pumped into the second well, thereby creating a second stored data record; and communicating the first stored data record and the second stored data record to a remote location relative to the first well site and the second well site.

* * * * *